United States Patent [19]

Kadle

[11] Patent Number: 5,029,636

[45] Date of Patent: Jul. 9, 1991

[54] OIL COOLER WITH LOUVERED CENTER

[75] Inventor: Prasad S. Kadle, Getzville, N.Y.

[73] Assignee: General Motors Corporation, Detroit, Mich.

[21] Appl. No.: 610,177

[22] Filed: Nov. 5, 1990

[51] Int. Cl.[5] ..... F28F 1/40; F28F 13/12

[52] U.S. Cl. ..... 165/109.1; 165/179; 165/916; 165/183; 138/38

[58] Field of Search ..... 165/109.1, 179, 916, 165/166, 183; 138/38

[56] References Cited

U.S. PATENT DOCUMENTS

| | | | |
|---|---|---|---|
| 2,161,887 | 6/1939 | Ramsaur | 138/38 |
| 2,359,288 | 10/1944 | Brinen | 138/38 |
| 4,945,981 | 8/1990 | Joshi | 165/109.1 |

FOREIGN PATENT DOCUMENTS

| | | | |
|---|---|---|---|
| 995294 | 8/1951 | France | 165/179 |
| 857707 | 1/1961 | United Kingdom | 165/179 |

*Primary Examiner*—Albert W. Davis, Jr.
*Attorney, Agent, or Firm*—Ronald L. Phillips

[57] ABSTRACT

An oil cooler center has a sinusoidally shaped plate with a center length which extends across the width of a longitudinal flow path through an oil cooler and with a center pitch formed between a pair of inclined walls that form a plurality of spaced oil chambers in the oil cooler having oil flow diverted therethrough by louvers formed in the walls to form inlets and outlets to and from the spaced oil chambers and wherein the louvers are inclined to mix the oil up and down in a plane perpendicular to the longitudinal flow path so as to break up a thermal boundary layer on the inner surface of the outside walls of an oil cooler.

6 Claims, 1 Drawing Sheet

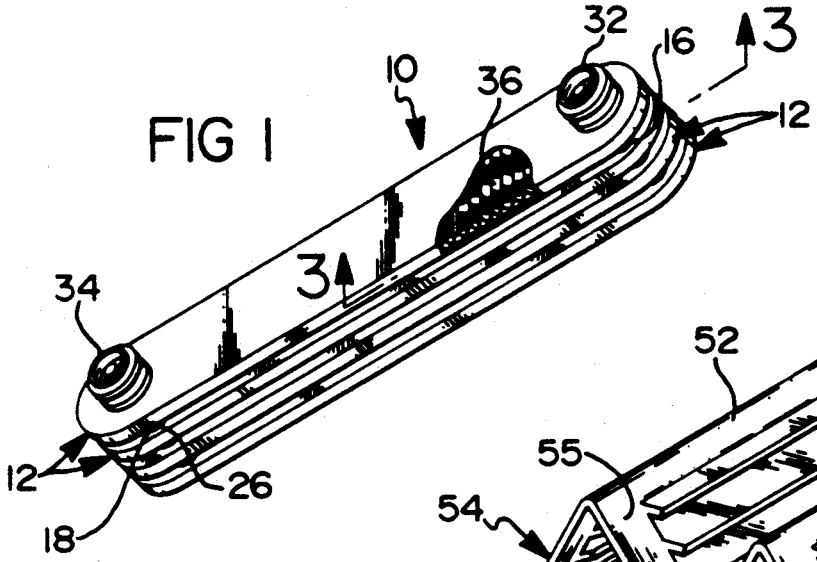
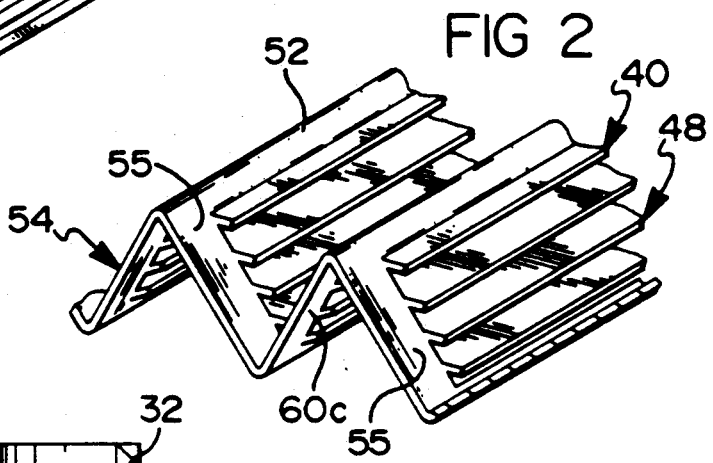
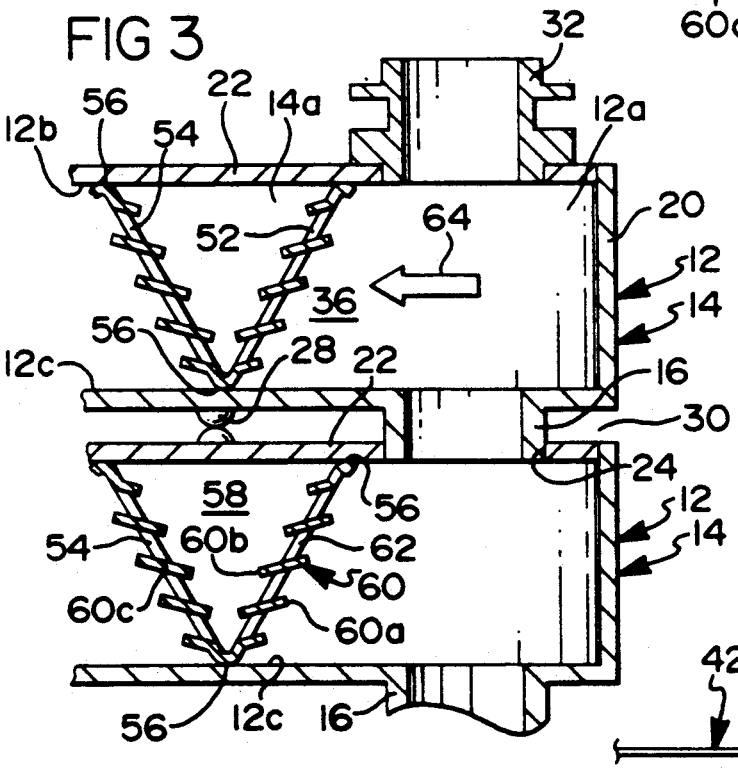
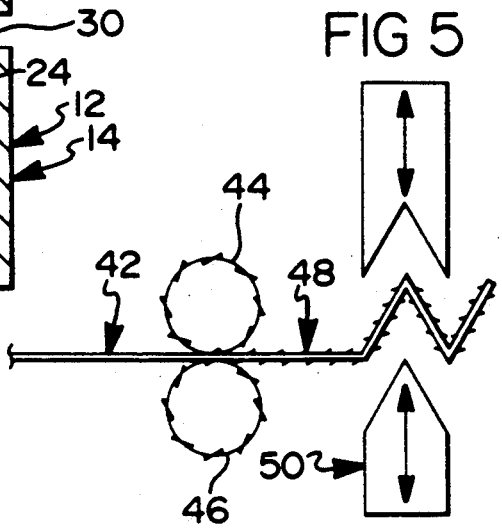
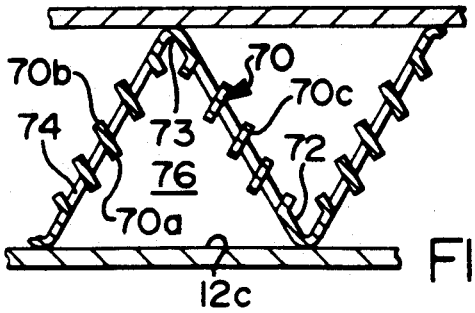
FIG 4

OIL COOLER WITH LOUVERED CENTER

FIELD OF THE INVENTION

This invention relates to oil coolers having spaced walls defining a longitudinal flow path for oil flow to be cooled by heat transfer through the spaced walls and more particularly to oil cooler centers for mixing the oil flow as it is directed through the longitudinal flow path so as to improve heat transfer across the spaced walls.

BACKGROUND OF THE INVENTION

In the past oil coolers have included a plurality of plates joined together to form a heat exchanger adapted to be connected in a coolant space of a radiator (or other suitable heat sink) for extracting heat from oil in a transmission or other apparatus in which the oil is circulated and heated during the operation of the transmission or other apparatus.

Oil cooler centers are located in the oil passages within such oil coolers to mix the oil so as to improve heat transfer therefrom. One such center is a strip fin of high heat conductivity metal such as copper which is inserted between two plates forming the walls of a longitudinally directed oil flow path through which oil is directed for extracting heat therefrom. In such arrangements the strip fins have included louvers in the walls of the strip fin arranged to extend along the height of the fin wall and wherein the mixing is limited to the plane of the oil flow through the oil passages within the oil cooler, e.g., the louvers only mixed the oil flow from side to side of the oil passage rather than up and down within the oil passage.

One problem with such arrangements is that the oil mixing pattern is in a direction which does not act of thermal boundary areas at the inner surface of the plates comprising the oil flow passages through the oil cooler.

Other prior art oil coolers are known in which a metal insert of high heat conductivity is inserted between oil cooler plates. Such prior art arrangements however, do not include sinusoidally configured oil centers which can be easily roll formed to a final shape that will fit existing oil cooler having the old stype strip fin centers. Examples of such prior art oil coolers include U.S. Pat. No. 2,222,721 having a corrugated plate therein with openings formed by webs in the plate to direct oil between spaced plates and U.S. Pat. No. 2,990,163 in which a corrugated strip is located in both cases oil is mixed side to side of the oil flow rather than up and down in the oil flow passage. U.S. Pat. No. 4,373,578 discloses a cylindrically shaped oil cooler in which a generally star shaped insert is located on the water side to mix the water to improve heat transfer from an annular oil passage that does not have an oil mixing insert therein. U.S. Pat. No. 4,580,625 shows an oil cooler with sinusoidal fins for oil cooling. The prior art configurations do not disclose an easily fabricated oil center for mixing oil while breaking up the thermal boundary layer in the oil flow therethrough

SUMMARY OF THE INVENTION

Summary of the Invention

Accordingly an object of the present invention is to provide an easily fabricated strip metal insert for use as an oil cooler center for mixing oil flow to enhance heat transfer from the oil flow while defining a oil flow pattern that will simultaneously break up the thermal boundary layer on the inner surfaces of plate portions of the oil cooler.

A further object of the present invention is to provide a strip metal insert in the form of a sinusoidally shaped plate having pairs of walls forming separate oil chambers between spaced plates of an oil cooler and wherein each of the pairs of walls includes louvers formed therein in a direction parallel to the width of the walls and inclined to mix longitudinal oil flow through the plates top to bottom of the oil passage in a plane perpendicular to the oil flow for breaking up the thermal boundary layer on the inner surfaces of plate portions of the oil cooler.

A feature of the present invention is to provide a sinusoidally shaped metal insert for an oil cooler that is easily formed by gears or rollers in a continuous process to have louvers integrally formed across the width of the shaped plate and inclined with respect to plate parts of the metal insert to mix oil in an oil cooler from the top to bottom of a longitudinal passage therethrough in a plane perpendicular to oil flow through the oil passage.

Still another feature of the present invention is a heat exchanger having a pair of spaced walls enclosing a liquid flow space communicated at opposite points therein by inlet and outlet fittings adapted to be connected in a system having oil flow therethrough requiring cooling wherein the heat exchanger has a sinusoidally shaped metal insert located therein for mixing oil flow through the liquid flow space between the inlet and outlet fittings; the sinusoidally shaped metal insert having a width substantially corresponding to the width of the liquid flow space and including reversely bent parts thereon in engagement with the spaced walls at points therealong determined by the pitch of the sinusoidally shaped metal insert; the sinusoidally shaped metal insert having wall parts joining the reversely bent parts; each of said wall parts being inclined with respect to the flow through the liquid flow space between said inlets and outlets; and louvers formed in each of the wall parts for causing generally longitudinal flow through said liquid flow space to be directed up and down in the liquid flow space in a plane generally perpendicular to the direction of oil flow through the oil cooler.

A further feature is to provide the heat exchanger of the preceding paragraph further characterized by the sinusoidally shaped metal insert having spaced side portions and the louvers having an inlet edge, an outlet edge and opposite end portions integrally joined to the side portions of sinusoidally shaped metal insert and pairs of each of the louvers defining flow paths into and out of the fluid spaces between the wall parts.

A further feature of the invention is to provide a heat exchanger as set-forth in the preceding paragraphs further characterized by the sinusoidally shaped metal insert having a pair of wall parts joined at one end to one of the reversely bent parts to form an apex located against one of the spaced walls; the pair of wall parts including an upstream wall part and a downstream wall part; the louvers in the upstream wall part diverting oil flow toward the apex and the louvers in the downstream wall part diverting oil flow away from the apex.

Yet another feature of the invention is to provide another embodiment of such a heat exchanger wherein the sinusoidally shaped insert has a pair of wall parts joined at one end to one of the reversely bent parts to form an apex located against one of the spaced walls;

the pair of wall parts including an upstream wall part and a downstream wall part; the louvers in the upstream wall part diverting oil flow away from the apex and said louvers in said downstream wall part diverting oil flow toward the apex.

These and other objects, features and advantages of the present invention will become more apparent in view of the accompanying description when taken in conjunction with the drawings in which:

BRIEF DESCRIPTION OF THE DRAWINGS

FIG. 1 is a perspective view of an oil cooler including the present invention;

FIG. 2 is a fragmentary perspective view of one embodiment of a metal insert of the present invention;

FIG. 3 is an enlarged sectional view taken along the line 3—3 of FIG. 1 looking in the direction of the arrows;

FIG. 4 is a sectional view of a metal insert in another embodiment of the invention; and FIG. 5 is a perspective view of rollers for forming the metal insert of the present invention.

DETAILED DESCRIPTION OF PREFERRED EMBODIMENTS OF THE INVENTION

Referring now to FIG. 1, an oil cooler 10 is shown of the type which are located in the coolant space of a radiator for extracting heat from oil circulating in apparatus on a vehicle such as motor oil; transmission oil or hydrodynamic convertor oil.

In the illustrated arrangement the oil cooler 10 includes four discs 12 each including a spaced tube wall 14 having a tube fitting 16, 18 brazed at opposite ends thereof. Each spaced wall 14 has a peripheral flange 20 brazed to a cover wall 22 with spaced openings 24, 26 in which the fittings 16, 18 are connected by brazing or by other suitable connection. Each of the cover walls 22 and tube fitting walls 14 have dimples 28 formed therein that are aligned to support the discs 12 apart for defining a water coolant passage 30 between each of the discs 12 through which the engine coolant can be directed during engine operation. While the oil cooler 10 is described as being water cooled, it is suitable for use in other environments in which other media is directed across the discs for removing heat from oil circulated therethrough.

The oil cooler 10 has an inlet fitting 32 and an outlet fitting 34 connected at opposite ends of an outer cover wall 22*a*. The fittings 32, 34 are adapted to be connected in an oil circuit for receiving heated oil from associated apparatus at the inlet fitting 32 and for return of cooled oil to the associated apparatus from the outlet fitting 34.

In accordance with the invention oil is directed from an inlet end 12*a* of each of the discs 12 through a longitudinal oil space 36 formed in each of the discs 12 along the length thereof to the outlet tube fittings 18 where the oil is collected for return flow through the outlet fitting 34. Such flow produces a laminar thermal boundary layer at the inside surfaces 12*b* and 12*c* of each of the discs 12. Such thermal boundary layers tend to insulate conductive heat transfer through the walls of the discs 12 into the water circulating through the water coolant passages 30.

One aspect of the present invention is a metal insert 40 located in each of the oil spaces 36 to both mix and flow the circulating oil in a manner to break up the thermal boundary layer at the inside surfaces 12*c* and 12*d*. More particularly, the metal insert 40 is a sinusoidally shaped metal strip 40 having a thickness in the range of 0.003–0.006 inches; a width in one working embodiment of 1.6 inches; a center height of 0.25 inches; a center pitch of 0.120 inches.

As diagrammatically shown in FIG. 5, the metal strip 40 is formed continuously by directing a blank strip 42 through a pair of gears or rollers 44 having a louver pattern 46 formed in its surface; following formation of louvers 48 in the blank strip 42, the strip 42 is passed through a shaping station 50 for forming the sinusoidal shape.

Referring to FIGS. 2 and 3, each of the metal strips 40 has a plurality of pairs of wall parts 52, 54 joined at an apex 56. Each of the pairs of wall parts 52, 54 forms a oil chamber 58 across the width of each of the discs 12 on the oil side thereof.

Each of the wall parts 52, 54 has side segments 55 which extend along the length of each of the wall parts 52, 54 at each side thereof. Each of the side segments 55 engage a side wall portion 14*a*of each of the tube walls 14.

The wall parts 52, 54 each have a plurality of integral louvers 60 formed therein. Each of the louvers 60 are pierced from the blank strip 42 during the roll forming step described above to form inlet and outlet edges 60*a*, 60*b* that direct flow across the wall parts 52, 54 through openings 62 between each of the louvers 60 in a direction determined by the inclination of the louvers 60 with respect to the wall parts 52, 54. Each of the louvers 60 is integrally connected to the side segments 58 at twisted end segments 60*c* of the louvers 60.

In the embodiment of the invention shown in FIGS. 2 and 3, the louvers 60 on the upstream wall part 52 is inclined upwardly to direct oil flow into the oil chamber 58 in a direction toward the apex 56 in a plane which is generally perpendicular to the direction of the oil flow into the space 36 as shown by the arrow 64. The louvers 60 in the downstream wall part 54 are inclined to direct oil flow from the oil chamber 56 in a direction which is from the oil space in a plane which is generally perpendicular to the longitudinal direction of oil flow through the oil space 36. As a consequence, the oil flow from the inlet fitting 32 to the outlet fitting 34 is continuously mixed in a reversing direction between the surfaces 12*b*, 12*c* so as to break up any tendency to form a thermal boundary layer on such surfaces during oil flow through the discs 12. As a consequence, the heat overall heat transfer effectiveness is improved.

In the embodiment of the invention shown in FIG. 4, louvers 70 are provided in an upstream wall part 72 which are inclined to direct the oil flow downwardly away from an apex 73 joining the upstream wall part 72 to a downstream wall part 74 having an oil chamber 76 therebetween. Oil flow from the chamber 76 is directed by oppositely inclined louvers 70 in the downstream wall part 74 in a direction toward the apex. The resultant flow pattern of the oil is again in opposite directions toward inside wall surfaces of the disc in a plane generally perpendicular to the longitudinal axis of the oil space between the inlets and outlets of the discs.

While the invention has been described in conjunction with oil coolers having oil passages formed in disc type members, the invention is suitable for use in any heat exchanger in which thermal boundary layers are formed on inside surfaces along a generally axially directed fluid flow path. Finally, it will be understood that those skilled in the art that the foregoing description is of preferred embodiments of the disclosed device, and that various changes and modifications may be made to the present invention without departing from the spirit and scope thereof.

What is claimed is:

1. In a heat exchanger having a pair of spaced walls with inner surfaces enclosing a fluid flow space communicated at opposite points therein by inlet and outlet fittings adapted to be connected in a system having fluid flow therethrough requiring cooling the improvement comprising:

a sinusoidally shaped plate for mixing fluid flow through said fluid flow space between the inlet and outlet fittings; said sinusoidally shaped plate having a width substantially corresponding to the width of said fluid flow space and including reversely bent parts thereon in engagement with said spaced walls at points therealong determined by the pitch of said sinusoidally shaped plate;

said sinusoidally shaped plate having wall parts joining said reversely bent parts and forming a fluid space therebetween; each of said wall parts being inclined with respect to the flow through said fluid flow space between said inlets and outlets; and louvers formed in each of said wall parts for causing generally longitudinal flow through said fluid flow space to be directed into and out of said fluid spaces between each of said wall parts and to be directed periodically against the inner surface of said spaced walls.

2. The heat exchanger of claim 1 further characterized by said sinusoidally shaped plate having spaced side portions;

said louvers having an inlet edge, an outlet edge and opposite end portions integrally joined to said spaced side portions of said sinusoidally shape plate and pairs of each of said louvers defining flow paths into and out of said fluid spaces between said wall parts.

3. The heat exchanger of claim 2 further characterized by said sinusoidally shaped plate having a pair of wall parts joined at one end to one of said reversely bent parts to form an apex located against one of said spaced walls; said pair of wall parts including an upstream wall part and a down stream wall part; said louvers in said upstream wall part diverting fluid flow toward said apex and said louvers in said downstream wall part diverting fluid flow away from said apex so as to break up thermal boundary layer effects at said inner surfaces.

4. The heat exchanger of claim 2 further characterized by said sinusoidally shaped plate having a pair of wall parts joined at one end to one of said reversely bent parts to form an apex located against one of said spaced walls; said pair of wall parts including an upstream wall part and a downstream wall part; said louvers in said upstream wall part diverting fluid flow away from said apex and said louvers in said downstream wall part diverting fluid flow toward said apex so as to break up thermal boundary layer effects at said inner surfaces.

5. The heat exchanger of claim 1 further characterized by said sinusoidally shaped plate having a pair of wall parts joined at one end to one of said reversely bent parts to form an apex located against one of said spaced walls; said pair of wall parts including an upstream wall part and a downstream wall part; said louvers in said upstream wall part diverting fluid flow toward said apex and said louvers in said downstream wall part diverting fluid flow away from said apex so as to break up thermal boundary layer effects at said inner surfaces.

6. The heat exchanger of claim 1 further characterized by said sinusoidally shaped plate having a pair of wall parts joined at one end to one of said reversely bent parts to form an apex located against one of said spaced walls; said pair of wall parts including an upstream wall part and a downstream wall part; said louvers in said upstream wall part diverting fluid flow away from said apex and said louvers in said downstream wall part diverting fluid flow toward said apex so as to break up thermal boundary layer effects at said inner surfaces.

* * * * *